US011272794B2

(12) United States Patent
Nicholls

(10) Patent No.: US 11,272,794 B2
(45) Date of Patent: Mar. 15, 2022

(54) OPEN-FRONT REFRIGERATOR AND A METHOD OF COOLING ITEMS THEREIN

(71) Applicant: Vertical Cabinet Company Ltd, Oxfordshire (GB)

(72) Inventor: Michael Nicholls, Oxfordshire (GB)

(73) Assignee: Vertical Cabinet Company Ltd., Oxfordshire (GB)

( * ) Notice: Subject to any disclaimer, the term of this patent is extended or adjusted under 35 U.S.C. 154(b) by 379 days.

(21) Appl. No.: 16/099,236

(22) PCT Filed: Apr. 21, 2017

(86) PCT No.: PCT/IB2017/052310
§ 371 (c)(1),
(2) Date: Nov. 6, 2018

(87) PCT Pub. No.: WO2017/191523
PCT Pub. Date: Nov. 9, 2017

(65) Prior Publication Data

US 2019/0281997 A1 Sep. 19, 2019

(30) Foreign Application Priority Data

May 6, 2016 (GB) ..... 1607950

(51) Int. Cl.
*A47F 3/04* (2006.01)
*F25D 25/02* (2006.01)

(52) U.S. Cl.
CPC ..... *A47F 3/0447* (2013.01); *A47F 3/0491* (2013.01); *F25D 25/028* (2013.01); *A47F 2003/046* (2013.01)

(58) Field of Classification Search
CPC ..... A47F 3/0447; A47F 2003/046; A47F 3/0491; F25D 25/028
See application file for complete search history.

(56) References Cited

U.S. PATENT DOCUMENTS 2,499,088 A 2/1950 Brill et al.
3,168,818 A 2/1965 Weber
(Continued)

FOREIGN PATENT DOCUMENTS

CH 460066 A 9/1968
DE 4332773 A1 3/1995
(Continued)

OTHER PUBLICATIONS

English Translation of FR2262913 (Year: 1975).*
(Continued)

*Primary Examiner* — David J Teitelbaum
(74) *Attorney, Agent, or Firm* — Reichel Stohry Dean LLP; Mark C. Reichel; Natalie J. Dean

(57) ABSTRACT

The present invention relates to a display cabinet (1) having an open face; an air circulation system comprising: an air inlet (9) located adjacent to a perimeter of the open front face; an air outlet (7) located adjacent to the perimeter of the open front face opposite the air inlet (9), and configured to blow air across the open front face toward the air inlet (9); an air conduit (11, 17) for conveying air from the air inlet (9) to the air outlet (7); and an air pump configured to draw air from the air inlet (9), move the air thus drawn through the air conduit (11, 17) to the air outlet (7); and at least one shelf (3) disposed within the display cabinet (1); wherein the air conduit (11, 17) is arranged such that at least a portion (19) of the air from the air inlet (9) follows a path that passes out from a wall of the display cabinet (1) through the at least one shelf (3), and back through said at least one shelf (3) to the wall of the display cabinet (1), before being passed to the air outlet (7).

6 Claims, 6 Drawing Sheets

(56) References Cited

U.S. PATENT DOCUMENTS

| | | | | |
|---|---|---|---|---|
| 3,218,822 | A | 11/1965 | Bently et al. | |
| 3,263,745 | A | 8/1966 | Henry | |
| 3,369,375 | A | 2/1968 | Gerweck et al. | |
| 3,392,544 | A | 7/1968 | Perez | |
| 3,584,467 | A | 6/1971 | Barroero | |
| 6,041,616 | A | 3/2000 | Jeong | |
| 6,701,735 | B1 * | 3/2004 | Daddis, Jr. | A47F 3/0447 454/193 |
| 2003/0172670 | A1 | 9/2003 | Vormedal | |
| 2004/0177635 | A1 | 9/2004 | Yamazaki et al. | |
| 2005/0061758 | A1 | 3/2005 | Namura et al. | |
| 2006/0240761 | A1 | 10/2006 | Yamaguchi | |
| 2008/0236182 | A1 | 10/2008 | Hahn et al. | |
| 2010/0024446 | A1 | 2/2010 | Rohrer et al. | |
| 2013/0019621 | A1 | 1/2013 | Wood et al. | |
| 2015/0173527 | A1 | 6/2015 | Twohy | |

FOREIGN PATENT DOCUMENTS

| | | | | |
|---|---|---|---|---|
| DE | 20119347 | U1 | 2/2002 | |
| EP | 0589783 | A1 | 3/1994 | |
| EP | 1508288 | A1 | 2/2005 | |
| FR | 2262913 | A1 * | 10/1975 | F25D 25/028 |
| FR | 2690825 | A1 | 11/1993 | |
| GB | 2388185 | A | 5/2003 | |
| JP | S4845596 | A | 6/1973 | |
| JP | S51125372 | | 10/1976 | |
| JP | S55165468 | A | 12/1980 | |
| JP | 2005156034 | A | 6/2005 | |
| JP | 2012010903 | A | 1/2012 | |
| NL | 1028973 | D2 | 11/2006 | |
| WO | 9958916 | A1 | 11/1999 | |
| WO | 2007083002 | A1 | 5/2007 | |
| WO | 2008074355 | A1 | 6/2008 | |

OTHER PUBLICATIONS

International Searching Authority, International Search Report, PCT/IB2017/052310, dated Jul. 7, 2017.

International Searching Authority, Written Opinion of the International Searching Authority, PCT/IB2017/052310, dated Jul. 7, 2017.

International Preliminary Examining Authority, International Preliminary Report on Patentability, PCT/IB2017/052310, dated Jul. 20, 2018.

* cited by examiner

[Fig. 1]
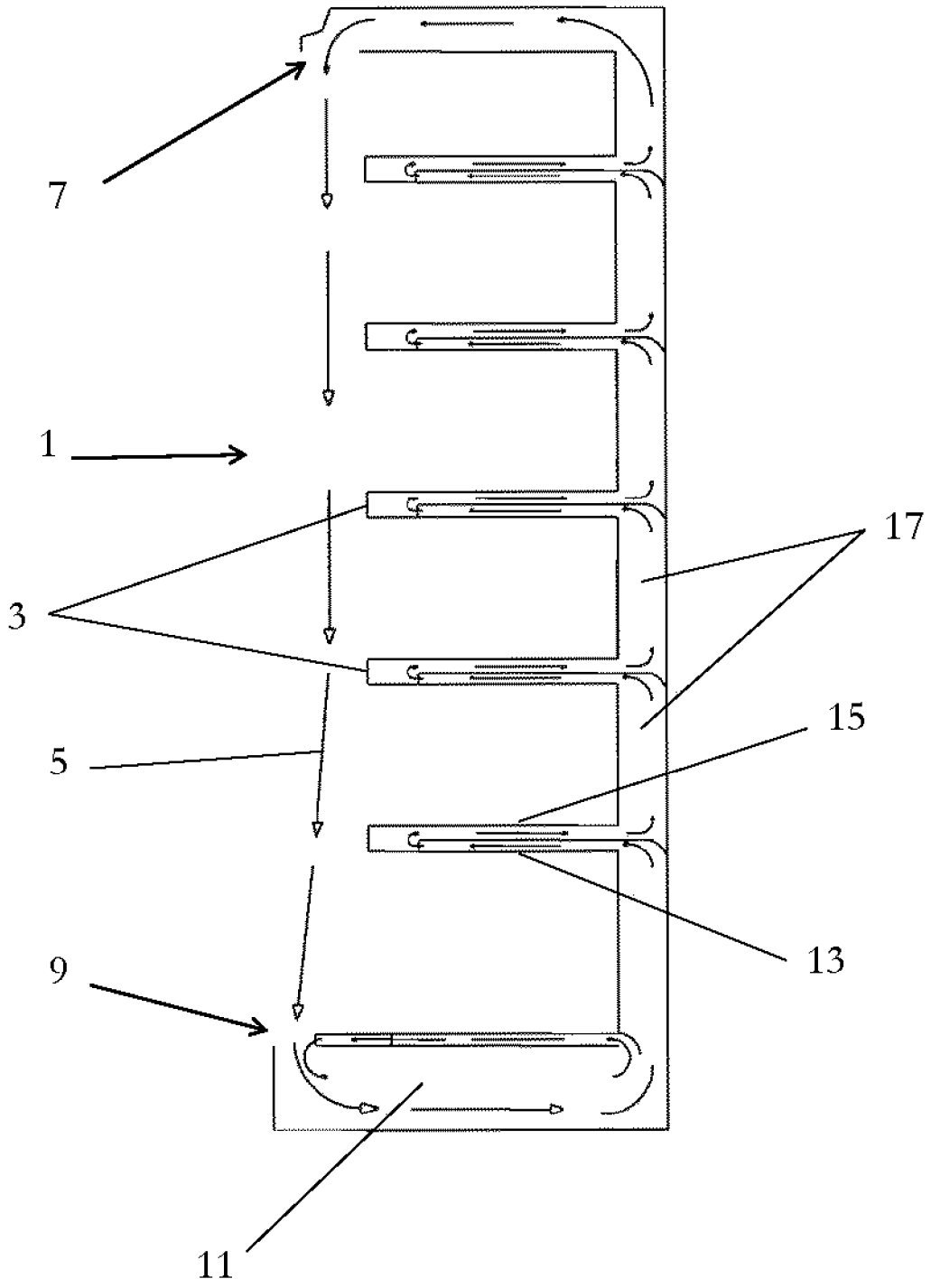

[Fig. 2]
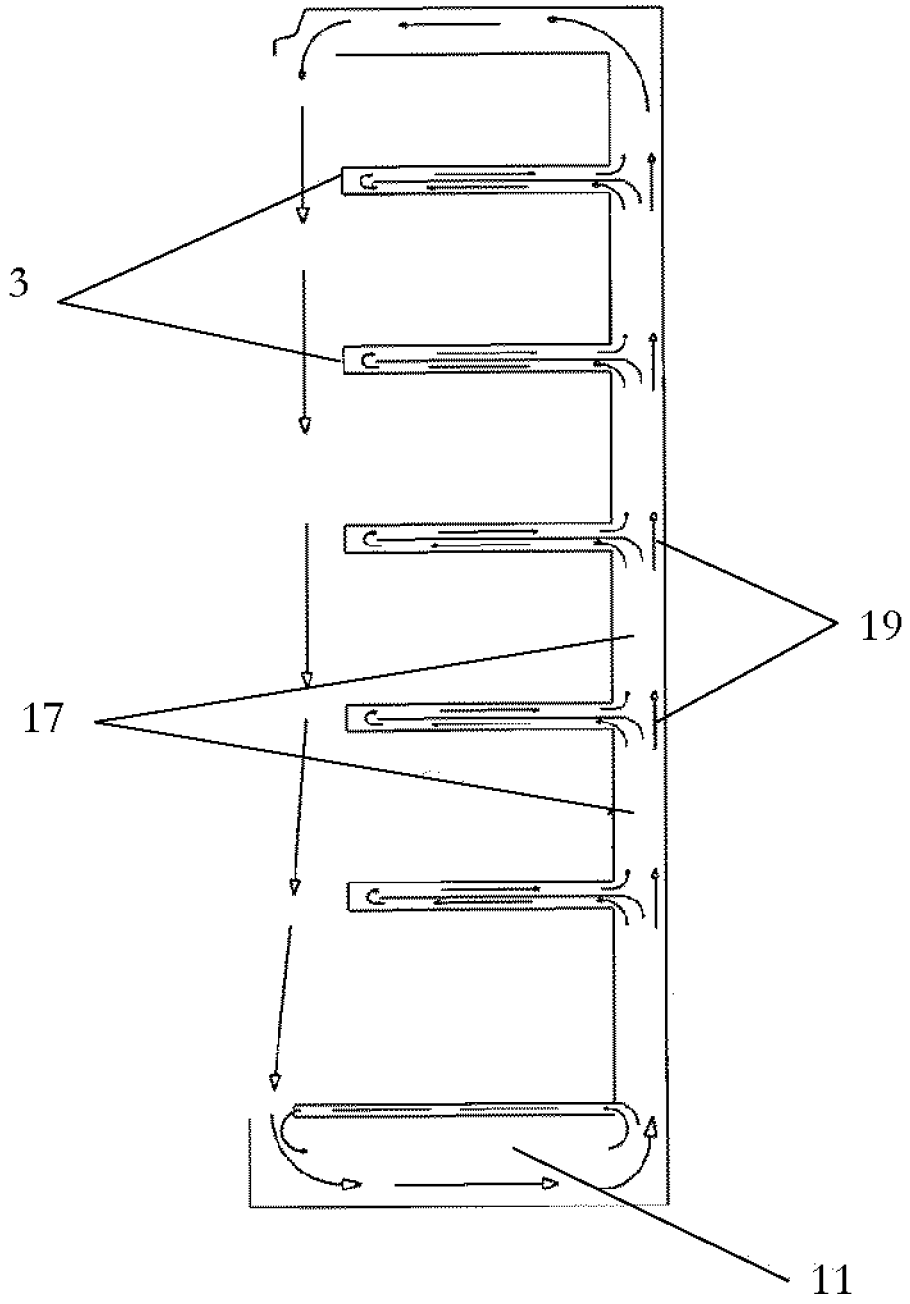

[Fig. 3]
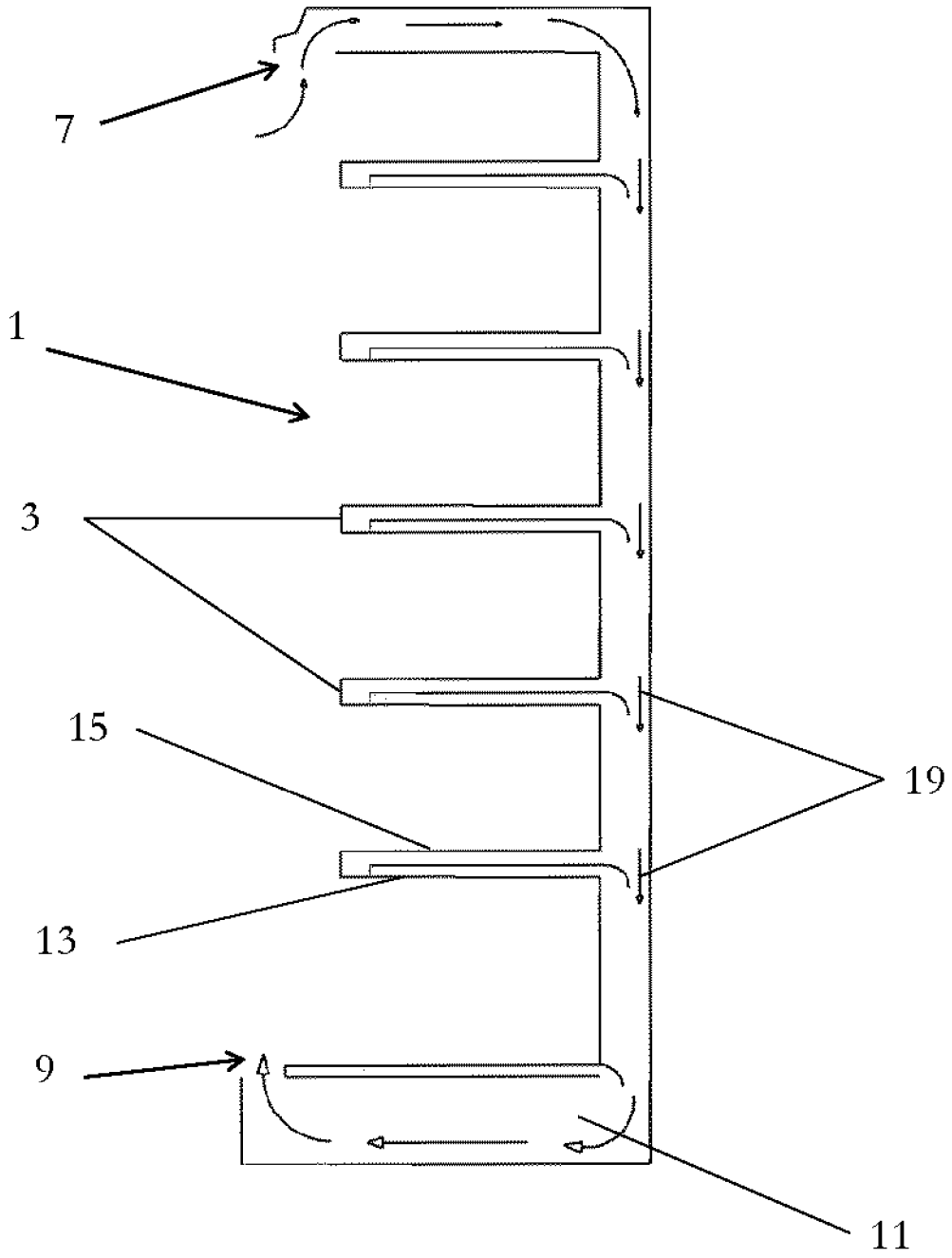

[Fig. 4]
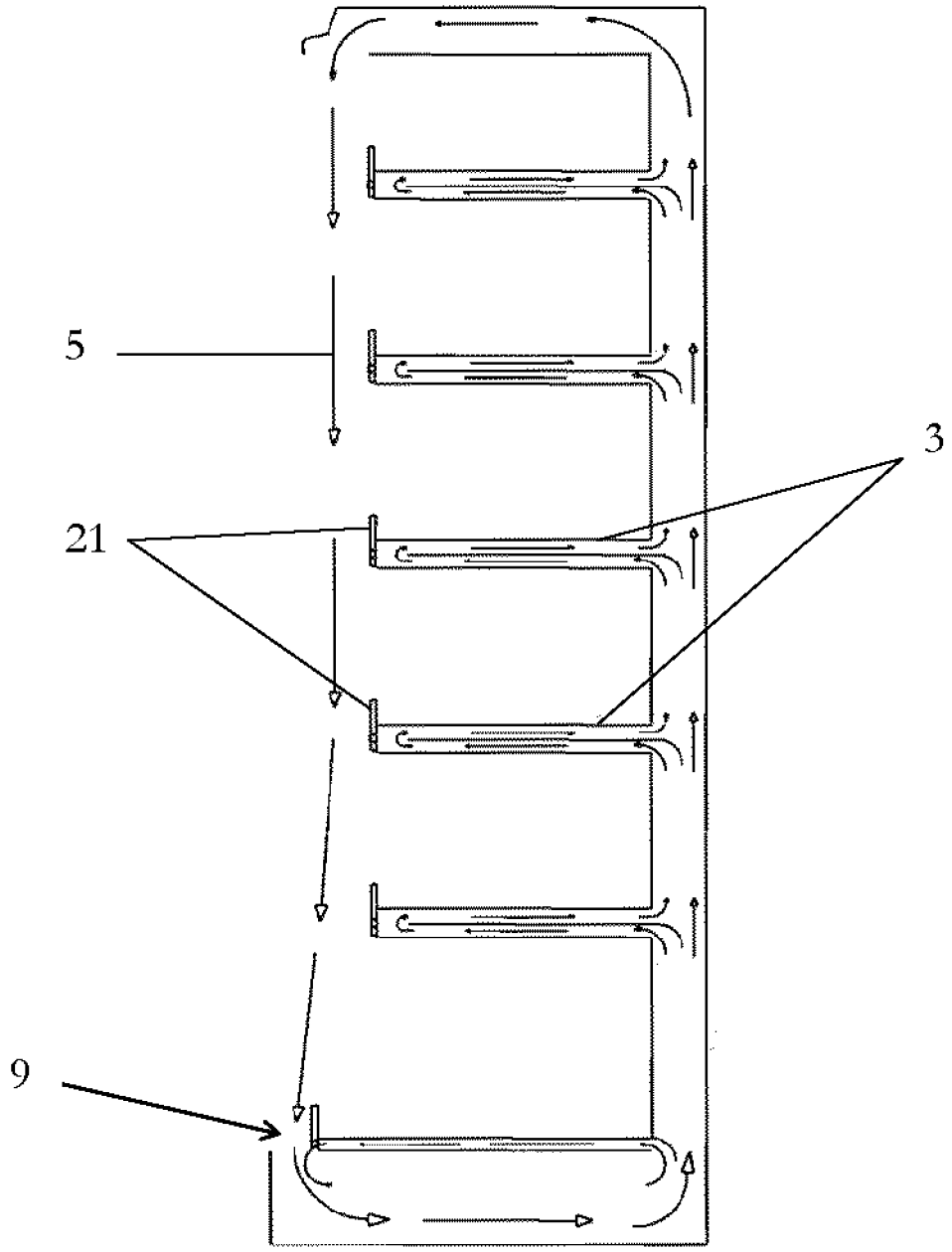

[Fig. 5]
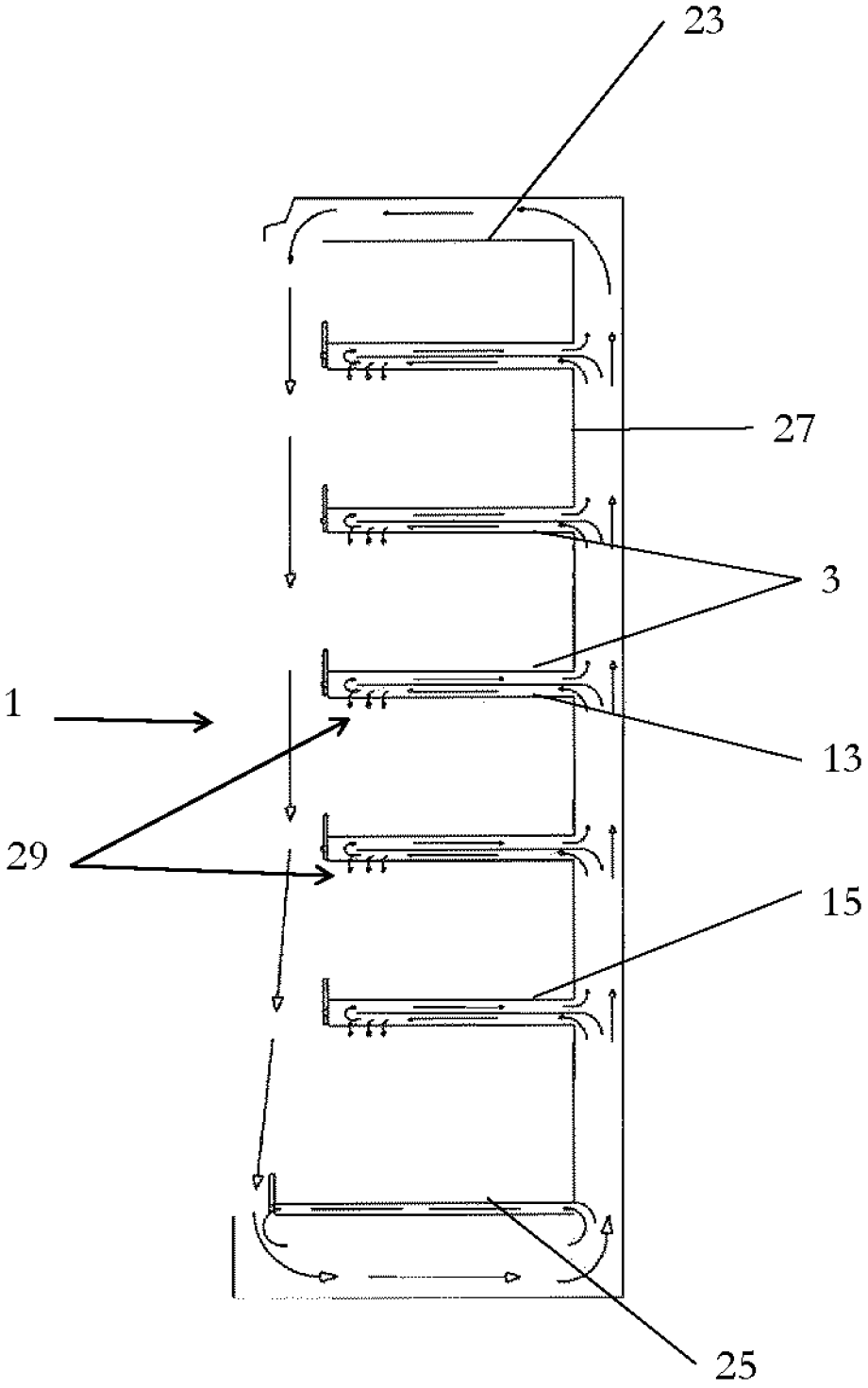

[Fig. 6]
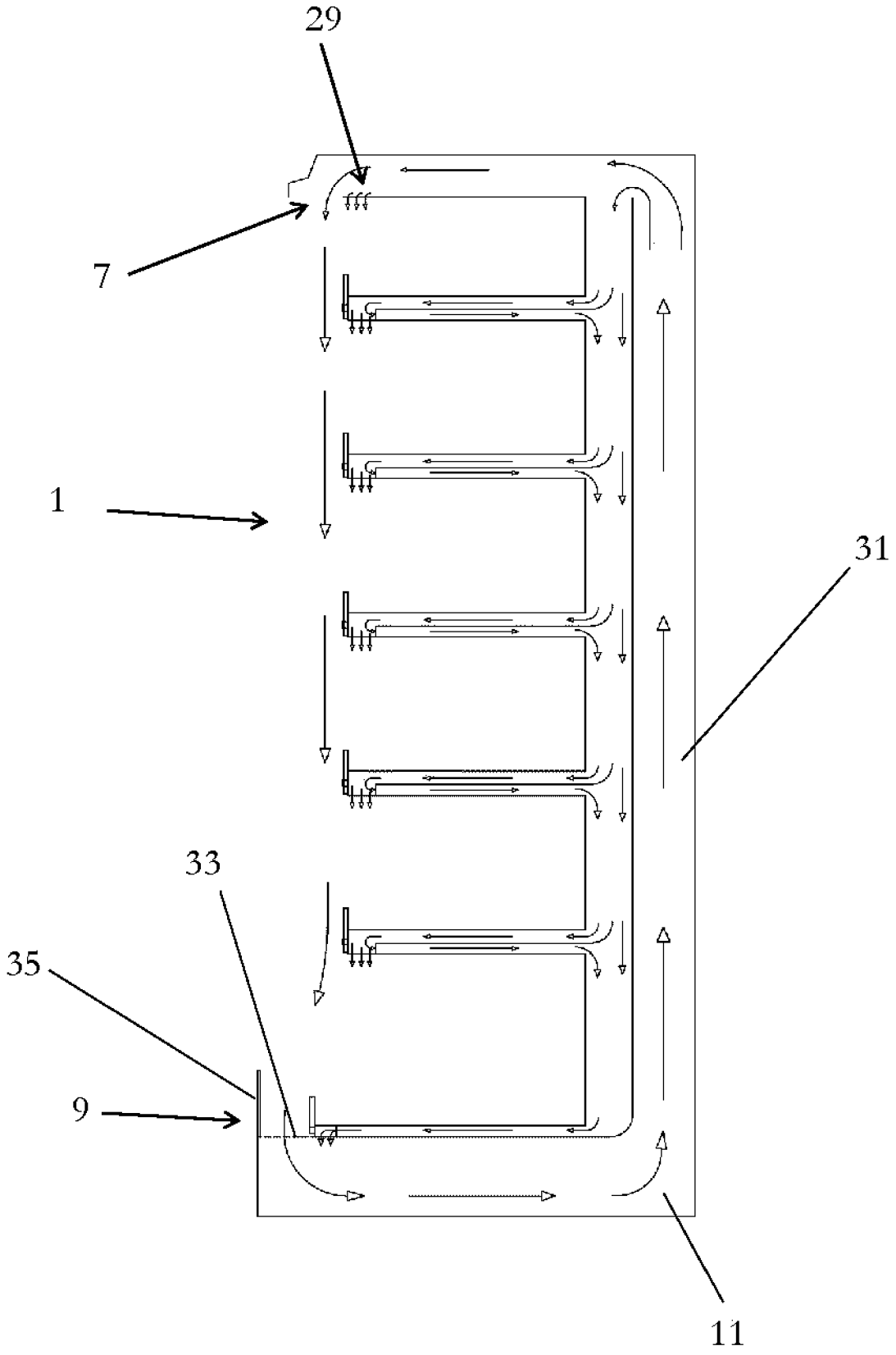

OPEN-FRONT REFRIGERATOR AND A METHOD OF COOLING ITEMS THEREIN

PRIORITY

The present application is related to, and claims the priority benefit of, and is a 35 U.S.C. 371 national stage application of, International Patent Application Serial No. PCT/IB2017/052310, filed Apr. 21, 2017, which is related to, and claims the priority benefit of, Great Britain Patent Application Serial No. 1607950.1, filed May 6, 2016. The contents of each of these applications are hereby incorporated by reference in their entirety into this disclosure.

TECHNICAL FIELD

The present invention relates to a method of cooling items and in particular to open-front refrigerators.

BACKGROUND

Refrigerators are known to have an interior volume, which is often thermally insulated, and a heat pump for transferring heat from the interior volume to an exterior of the refrigerator, such that the interior volume of the refrigerator is cooled to a temperature below an ambient temperature external to the refrigerator. Any form of heat pump may be used, for instance mechanical, electronic and/or electrical.

In particular, refrigerated shop display cabinets are often open-fronted (i.e. they have no front door, such that produce within is accessible to a passer-by), and therefore often include a cool air curtain produced by blowing cold air across an open front face of the cabinet, typically from the top to the bottom, which keeps the air within the display cabinet from mixing with ambient air outside the display cabinet, thereby keeping items cool that are located within the display cabinet.

In some open-front display refrigerators, goods are kept cool within the display cabinet by virtue of cool air being blown over the goods on the shelves, for instance from the back of the display cabinet, which then exits at the front of the display unit. By feeding air into the display cabinet, a positive air pressure is produced within the display cabinet (relative to ambient) which acts to push the air curtain outward, destroying a desired stable flow of air from top to bottom of the open face.

According to a first aspect of the present invention there is provided an open-front refrigerator comprising: a display cabinet having an open face; an air circulation system comprising: an air inlet located substantially adjacent to a perimeter of the open front face; an air outlet located substantially adjacent to the perimeter of the open front face substantially opposite the air inlet, and configured to blow air across the open front face toward the air inlet such that at least some of the air blown from the air outlet is blown into the air inlet; an air conduit for conveying air from the air inlet to the air outlet; and an air pump configured to draw air from the air inlet, move the air thus drawn through the air conduit to the air outlet, and blow the air thus moved out of the air outlet toward the air inlet; and at least one shelf disposed within the display cabinet for placing items to be refrigerated thereon; wherein the air conduit is arranged such that at least a portion of the air from the air inlet follows a path that passes out from a wall of the display cabinet through the at least one shelf, and back through said at least one shelf to the wall of the display cabinet, before being passed to the air outlet.

BRIEF SUMMARY

In this way, cool air is circulated through the shelves themselves in order to cool the products through contact with the shelves. Thus, destabilisation of the air curtain by positive air pressure within the display cabinet is avoided, yet the goods within the display cabinet are still able to be cooled by the circulating cool air flow.

The conduit may be configured such that all air from the air inlet follows the path that passes from a wall of the display cabinet, through the shelf and back to the wall before being passed to the air outlet.

In alternative arrangements, a first portion of the air from the air inlet follows the path that passes from a wall of the display cabinet, through the shelf and back to the wall before being passed to the air outlet, and a second portion of the air from the air inlet follows a further path. The further path may be a second path that bypasses the shelf, for instance by remaining within the wall of the display cabinet. For instance, the path and the further path may be two channel sections of the conduit split from the conduit.

The display cabinet may comprise a plurality of walls, for instance a top, bottom, back, right and left wall, to form an open-front box shape.

Alternatively or additionally, the display cabinet may comprise a single wall configured to extend around multiple faces of the display cabinet. For instance, a first wall may form the left, back and right faces of the display cabinet, and/or others.

In this way, the air conduit may be arranged such that at least a portion of the air from the air inlet follows a path that passes from a first wall portion making up one face of the display cabinet, through the shelf and to a second wall portion making up another face (e.g. an opposing face, or one located at right angles) of the display cabinet, before being passed to the air outlet.

The refrigerator may further comprise a heat pump for cooling the air received at the air intake, such that cool air may be passed to the shelf.

According to a second aspect of the present invention, there is provided a method of cooling items, the method comprising the steps of: providing an open-front refrigerator according to the first aspect; providing at least one item on the shelf of the open-front refrigerator; drawing air in from the air inlet; moving the air thus drawn through the air conduit, wherein moving the air comprises passing at least a portion of the air from the air inlet out from a wall of the display cabinet through the at least one shelf, and back through said at least one shelf to the wall of the display cabinet; and blowing the air thus moved out of the air outlet toward the air inlet, such that at least some of the air blown from the air outlet is blown into the air inlet.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

BRIEF DESCRIPTION OF THE DRAWINGS

FIG. 1 is a schematic view of air flow within a first open-front refrigerator operating under normal conditions.

FIG. 2 is a schematic view of air flow within a second open-front refrigerator operating under normal conditions.

FIG. 3 is a schematic view of air flow within the second open-front refrigerator in defrost operation.

FIG. 4 is a schematic view of air flow within a third open-front refrigerator operating under normal conditions.

FIG. 5 is a schematic view of air flow within a fourth open-front refrigerator operating under normal conditions.

FIG. 6 is a schematic view of air flow within a fifth open-front refrigerator operating under normal conditions.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

DETAILED DESCRIPTION

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances.

The principles of the invention will now be described by a detailed description of at least one drawing relating to exemplary features of the invention. It is clear that other arrangements can be configured according to the knowledge of persons skilled in the art without departing from the underlying concept or technical teaching of the invention, the invention being limited only by the terms of the appended claims.

FIG. 1 is a schematic view of air flow within a first open-front refrigerator operating under normal conditions. The refrigerator comprises an open-front display cabinet 1 inside which are provided five shelves 3, although any desired number of shelves is envisaged depending on the size of the cabinet 1 and the items (not shown) to be held therein.

A cool air curtain 5 is generated by blowing cool air out of an air outlet 7 toward an air inlet 9. Some of the air thus blown reaches the air inlet 9 and enters a conduit 11 as indicated by the arrows. The conduit 11 channels the cool air through each shelf 3.

FIG. 1 shows the air as being passed from the back of the cabinet 1 along an underside 13 of each shelf 3 and then being returned along an upper side 15 of each shelf 3 before returning to substantially upwardly directed portions of conduit 17 between the shelves.

It should be appreciated that this configuration is shown for clarity, and other configurations are also envisaged, such as having the conduit pass the air from the back of the cabinet 1 along the upper side 15 of each shelf 3 and then being returned along the underside 13 of each shelf 3 before returning to substantially upwardly directed portions of conduit 17 between the shelves.

Alternatively or additionally, the air may be passed along a circuitous, zig-zag and/or serpentine path within each shelf, in order to increase the amount of time the air spends in close proximity to the items to be cooled. In a further alternative or additional arrangement, the air may be passed from one side of the cabinet 1 (e.g. out of the drawing) substantially horizontally to an opposing side of the cabinet 1 (e.g. into the drawing) through the shelf 3.

The refrigerator may also include equipment (not shown) to cool the air received at the air inlet, for instance substantially immediately after entry into the conduit, or at some other point in the conduit, such that ambient air drawn into the inlet may be cooled to a usable temperature.

A pump (not shown) is arranged to drive air around the conduit and into/out of the inlet/outlet, respectively.

FIG. 2 is a schematic view of air flow within a second open-front refrigerator operating under normal conditions. The second open-front refrigerator differs from the first open-front refrigerator in that a portion 19 of the conduit 11 may bypass each shelf 3, thereby allowing some air within the conduit to move directly between adjacent substantially upwardly directed portions of conduit 17 between the shelves 3, without passing through the shelves 3. This may be enabled by various means; however, the present figure shows simple air channel guides/deflectors which may be embodied in various forms.

It is to be understood that it is not necessary for each shelf 3 to be bypassable by conduit portions 19, but that some shelves may be bypassable as in FIG. 2, whilst other shelves may not be bypassable as in FIG. 1. Alternatively or additionally, the degree to which a proportion of air is directed into the shelves or bypasses the shelves may be predetermined by fixed internal construction, or may be controllable (for instance dynamically) to control the temperature of each shelf 3. The temperature of a/each shelf (and/or the space above a/each shelf) 3 may be sensed, and the amount of airflow within the associated shelf/shelves 3 may be controlled accordingly, for instance automatically.

FIG. 3 is a schematic view of air flow within the second open-front refrigerator, in a defrost operation. In this arrangement, an air pump within the refrigerator may be reversed (or a secondary air pump may be initiated) to move air around the conduit 11 in a reverse direction. That is, the air may enter the outlet 7 and be drawn through the conduit to be vented at the inlet 9.

The inlet 9 may be configured such that air vented therefrom is not blown toward the outlet 7 in the form of an air curtain, but instead is mixed with ambient air. In this way, the air entering the outlet 7 will be substantially warmer than the air leaving the inlet 9. In particular, generally in an environment in thermal equilibrium (e.g. dynamic equilibrium), air at a higher level is warmer due to the fact that warmer air is less dense than cooler air and therefore rises. Thus, warm air will be drawn into the outlet 7, gradually cooled as it passes through the conduit 11, and cooler air exits the inlet 9. As the inlet 9 is below the outlet 7, there will be no tendency for the cool air to rise toward the outlet 7, unlike in normal operation (refrigeration) where cool air exiting the outlet 7 will tend to descend toward the inlet 9.

In alternative arrangements, the warm air from the outlet 9 may pass through the conduit 11 to move through the shelves 3 to defrost them. However, in the arrangement shown in FIG. 3, the conduit is configured to direct the warm air instead through the bypass portions 19 of the conduit 11 instead of through the upper side 15 and the underside 13 of each shelf 3. In this way, the main cooling system and air curtain system of the refrigerator may be defrosted whilst still ensuring that the items within the display cabinet 1 remain cold on the shelves 3; otherwise, much of the heat from the warming air would be lost in warming the items on the shelves 3 instead of acting to defrost the refrigerator. This directing may be enabled by various means; however, the present figure shows simple air channel guides/deflectors which may be embodied in various forms.

It is to be appreciated that the defrosting ability of the refrigerator of FIG. 3 is not limited to only configuration of the second open-front refrigerator, but may be applied to substantially any open-front refrigerator configuration.

FIG. 4 is a schematic view of air flow within a third open-front refrigerator operating under normal conditions. The third open-front refrigerator differs from the second open-front refrigerator in the inclusion of shelf-front uprights 21. However, it is to be appreciated that an alternative open-front refrigerator may be provided that differs from the first open-front refrigerator merely in the inclusion of shelf-front uprights 21; that is, specific internal configuration of the channel 11 shown in FIGS. 2 and 3 are not necessary for the arrangement shown in FIG. 4. The uprights 21 extend substantially across an entire shelf 3 front, such that mixing of air within the air curtain 5 and air between the shelves 3 is reduced. In particular, laminar flow of air within the air curtain 5 is improved such that destabilisation of the air curtain is reduced. Due to the cooling effect of air within the shelves 3, and the tendency for relatively cool, dense air to sink, the air immediately above each shelf 3 is likely to be cooler than the air immediately below an adjacent shelf. The location of the uprights 21, extending up from the front of each shelf 3, prevents the relatively dense relatively cool air immediately above the shelf 3 from rolling off the front of the shelf and interfering with the air curtain 5. Specifically, by interfering is meant that relatively cool, relatively dense air rolling off the front of a shelf would act to push the air curtain 5 outward, thereby destabilising the (e.g. laminar) flow within the air curtain, which would reduce the amount of cool air entering the inlet 9, and would thereby reduce the efficiency of the refrigerator.

FIG. 5 is a schematic view of air flow within a fourth open-front refrigerator operating under normal conditions. The fourth open-front refrigerator differs from the third open-front refrigerator in that at least one vent 29 is provided on the underside 13 of each shelf 3 to blow cold air onto/over items located on the shelves 3. However, it is to be appreciated that an alternative open-front refrigerator may be provided that differs from the first or second open-front refrigerators merely in that the at least one vent 29 is provided on the underside 13 of each shelf 3 to blow cold air onto/over items located on the shelves 3; that is, the shelf-front uprights 21 are not necessary for the arrangement shown in FIG. 5. As with previous discussions, although the present Figure shows the vents on every shelf 3, it is envisaged that the vent(s) 29 could be located only on a subset of the shelves 3 (e.g. on only one shelf 3), and/or on a wall of the cabinet 1, such as the top 23, bottom 25, side (not shown) or back 27. Alternatively or additionally, the at least one vent 29 may be provided on the upper side 15 of each shelf.

Each vent 29 may comprise, for example, a plurality of holes/slots or a single hole/slot, and may extend substantially across an entire width of the shelf 3.

FIG. 6 is a schematic view of air flow within a fifth open-front refrigerator operating under normal conditions. The fifth open-front refrigerator differs from the fourth open-front refrigerator in that the conduit 11 passes cool air first up to the top of the cabinet 1, before passing a portion of the air back down through each shelf 3. However, it is to be appreciated that an alternative open-front refrigerator may be provided that differ from the first, second or third open-front refrigerators in a similar manner; that is, the shelf-front uprights 21, vents 29, and specific conduit configuration are not necessary for the arrangement shown in FIG. 6.

Passing air first up the back 31 of the cabinet 1 allows additional cooling of ambient air drawn in through the inlet 9 before it is used to cool the shelves 3. In particular, it is often convenient to have an air cooling system (not shown) located at the back 31 of the cabinet 1. The arrangement of the conduit 11 at the back 31 of the cabinet 1 is shown as being straight and substantially vertical for clarity; however, it may be preferable to form the conduit 11 at the back 31 of the cabinet 1 in a serpentine or zig-zag shape in order to increase the cooling time (i.e. by increasing the distance over which cooling of the air can occur).

In this figure, only a portion of the air is sent back down to cool the shelves 3, and selection of this proportion of air may be fixed, variable or even dynamically variable, as discussed above with regard to the proportion of air that passes into a shelf 3 rather than bypassing a shelf 3.

FIG. 6 also shows a grill 33 on the intake 9 to prevent accidental ingress of items/particles, an intake front 35 to help guide air blown from the outlet 7 into the inlet 9, and one of the vents 29 located above the top shelf 3 adjacent to the outlet 7; however, each of these features is optional.

In the figures, for simplicity, each shelf 3 is shown substantially identical to each other shelf 3; however, it is to be appreciated that each shelf 3 may differ from each or at least one other shelf 3. For instance, the shelves 3 may project different distances from the rear of the cabinet 1, some shelves may be provided with shelf fronts 21 or not, and some shelves may be provided with vents 29 or not.

The invention claimed is:

1. An open-front refrigerator comprising:

a display cabinet having an open face;

an air circulation system comprising:

an air inlet located adjacent to a perimeter of the open front face;

an air outlet located adjacent to the perimeter of the open front face opposite the air inlet, and configured to blow air across the open front face toward the air inlet such that at least some of the air blown from the air outlet is blown into the air inlet;

an air conduit for conveying air from the air inlet to the air outlet; and an air pump configured to draw air from the air inlet, move the air thus drawn through the air conduit to the air outlet, and blow the air thus moved out of the air outlet toward the air inlet;

at least one shelf disposed within the display cabinet for placing items to be refrigerated thereon; and wherein the air conduit is arranged such that at least a portion of the air from the air inlet follows a path that passes out from a wall of the display cabinet through a first side of the at least one shelf, and directly returns along a second side of the at least one shelf to the wall of the display cabinet, before being passed to the air outlet.

2. The open-front refrigerator of claim 1, wherein the air conduit is configured such that all air from the air inlet follows the path that passes from a wall of the display cabinet, through the shelf and back to the wall before being passed to the air outlet.

3. A method of cooling items, the method comprising the steps of:

providing an open-front refrigerator according to claim 2;

providing at least one item on the shelf of the open-front refrigerator;

drawing air in from the air inlet;

moving the air thus drawn through the air conduit, wherein moving the air comprises passing at least a portion of the air from the air inlet out from a wall of the display cabinet through the at least one shelf, and back through said at least one shelf to the wall of the display cabinet; and blowing the air thus moved out of the air outlet toward the air inlet, such that at least some of the air blown from the air outlet is blown into the air inlet.

4. The open-front refrigerator of claim 1, wherein the air conduit is configured such that a first portion of the air from the air inlet follows the path that passes from a wall of the display cabinet, through the shelf and back to the wall before being passed to the air outlet, and a second portion of the air from the air inlet follows a further path that bypasses the shelf.

5. A method of cooling items, the method comprising the steps of:

providing an open-front refrigerator according to claim 4;

providing at least one item on the shelf of the open-front refrigerator;

drawing air in from the air inlet;

moving the air thus drawn through the air conduit, wherein moving the air comprises passing at least a portion of the air from the air inlet out from a wall of the display cabinet through the at least one shelf, and back through said at least one shelf to the wall of the display cabinet; and blowing the air thus moved out of the air outlet toward the air inlet, such that at least some of the air blown from the air outlet is blown into the air inlet.

6. A method of cooling items, the method comprising the steps of:

providing an open-front refrigerator according to claim 1;

providing at least one item on the shelf of the open-front refrigerator;

drawing air in from the air inlet;

moving the air thus drawn through the air conduit, wherein moving the air comprises passing at least a portion of the air from the air inlet out from a wall of the display cabinet through the at least one shelf, and back through said at least one shelf to the wall of the display cabinet; and blowing the air thus moved out of the air outlet toward the air inlet, such that at least some of the air blown from the air outlet is blown into the air inlet.

* * * * *